United States Patent [19]

Blackmon et al.

[11] 4,349,604

[45] Sep. 14, 1982

[54] CONTINUOUS FILAMENT YARN WITH WOOL-LIKE HAND

[75] Inventors: Lawrence E. Blackmon, Foley, Ala.; John R. Dees, Pensacola, Fla.; Darrell A. Kelly, Milton, Fla.; Wayne T. Mowe; Jing-peir Yu, both of Pensacola, Fla.

[73] Assignee: Fiber Industries, Inc., Charlotte, N.C.

[21] Appl. No.: 202,551

[22] Filed: Oct. 31, 1980

Related U.S. Application Data

[60] Continuation-in-part of Ser. No. 6,139, Jan. 24, 1979, which is a division of Ser. No. 947,687, Oct. 2, 1978, abandoned.

[51] Int. Cl.[3] ..... D02G 3/00

[52] U.S. Cl. ..... 428/370; 57/245; 428/369; 428/373; 428/397; 428/399

[58] Field of Search ..... 428/296, 369, 371, 373, 428/399, 400, 374; 57/208, 206, 246, 243, 245, 248, 251, 244; 156/167, 180; 264/177 F, 171

[56] References Cited

U.S. PATENT DOCUMENTS

| | | | |
|---|---|---|---|
| 3,061,998 | 11/1962 | Bloch | 57/251 X |
| 3,199,281 | 8/1965 | Maerov et al. . | |
| 3,350,871 | 11/1967 | Pierce et al. | 57/246 X |
| 3,587,221 | 6/1971 | Buzano | 428/369 X |
| 4,170,867 | 10/1979 | Leininger | 57/245 |

FOREIGN PATENT DOCUMENTS

| | | |
|---|---|---|
| 43-22339 | 9/1968 | Japan . |

*Primary Examiner*—Lorraine T. Kendell
*Attorney, Agent, or Firm*—Herbert M. Adrian, Jr.

[57] ABSTRACT

A yarn for producing fabrics with a wool-like hand, by combining textured filaments with longer filaments preferably of larger average denier. The longer filaments thus protrude in loops from the yarn bundle.

7 Claims, 6 Drawing Figures

CONTINUOUS FILAMENT YARN WITH WOOL-LIKE HAND

This application is a continuation-in-part of U.S. patent application Ser. No. 6,139 filed Jan. 24, 1979 which in turn is a division of U.S. patent application Ser. No. 947,687 filed Oct. 2, 1978 (now abandoned).

The invention relates to the art of melt-spun synthetic yarns and processes for their production, and more particularly to such yarns which combine high crimp with a wool-like hand.

It is known to produce somewhat bulky yarns by combining filaments with different shrinkages into a yarn, then shrinking so that the resulting longer filaments protrude in loops from the yarn. This may be done by spinning the filaments from different polymers, as in Reese U.S. Pat. No. 3,444,681, or by spinning from different filament cross-sections from a common polymer, as typified by several patents. Such known yarns ordinarily do not have high bulk, nor do fabrics made therefrom ordinarily provide a hand similar to that of wool, combining an initial crispness on light touch with softness on more firm compression.

These and other difficulties of the prior art are avoided by the present invention, which provides novel and useful processes and improved yarn products.

According to a first major aspect of the invention, there is provided a multifilament yarn comprising first and second classes of filaments; each of the first class of filaments being polyester and having shrinkage profiles in the form of shrinkage peaks and valleys along their lengths, the shrinkage peaks and valleys being out of phase from filament to filament and having amplitudes and spacings along each of the filaments of the first class selected such that the yarn has a crimp above 2%; each of the second class of filaments having lower shrinkage than the shrinkage of the filaments of the first class.

According to another aspect, each of the second class of filaments has a denier larger than the average denier of the first class of filaments.

According to another aspect, the second class of filaments are polyester.

According to another aspect, the shrinkage peaks and valleys have amplitudes and spacings selected such that the yarn has a crimp above 3%.

These and other aspects of the invention will in part appear hereinafter and will in part be obvious from the following detailed description taken in connection with the accompanying drawings wherein.

Figure 1:
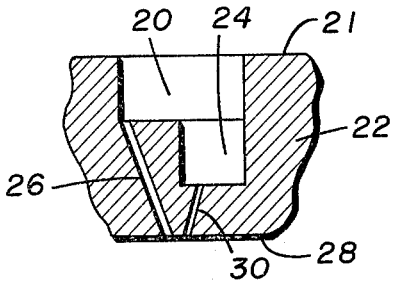
FIG. 1 is a vertical sectional view of the preferred embodiment of a spinneret usable to make the first type of filaments.
Figure 2:
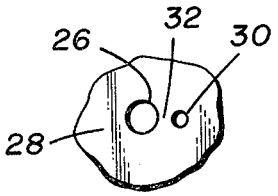
FIG. 2 is a bottom plan view of the FIG. 1 spinneret, looking up.

FIGS. 1 and 2 illustrate the preferred embodiment of a spinneret design which can be employed for obtaining the first type of filaments according to the invention. The spinneret includes a large counterbore 20 formed in the upper surface 21 of spinneret plate 22. Small counterbore 24 is formed in the bottom of and at one side of large counterbore 20. A large capillary 26 extends from the bottom of large counterbore 20 at the side opposite small counterbore 24, and connects the bottom of large counterbore 20 with the lower surface 28 of plate 22. Small capillary 30 connects the bottom of counterbore 24 with surface 28. Capillaries 26 and 30 are each inclined four degrees from the vertical, and thus have an included angle of eight degrees. Counterbore 20 has a diameter of 0.113 inch (2.87 mm.), while counterbore 24 has a diameter of 0.052 inch (1.32 mm.). Capillary 26 has a diameter of 0.016 inch (0.406 mm.) and a length of 0.146 inch (3.71 mm.), while capillary 30 has a diameter of 0.009 inch (0.229 mm.) and a length of 0.032 inch (0.813 mm.). Land 32 separates capillaries 26 and 30 as they emerge at surface 28, and has a width of 0.0043 inch (0.109 mm.). Plate 22 has a thickness of 0.554 inch (14.07 mm.). Capillaries 26 and 30 together with counterbores 20 and 24 constitute a combined orifice for spinning various novel and useful filaments according to the invention, as will be more particularly described hereinafter.

Figure 4:
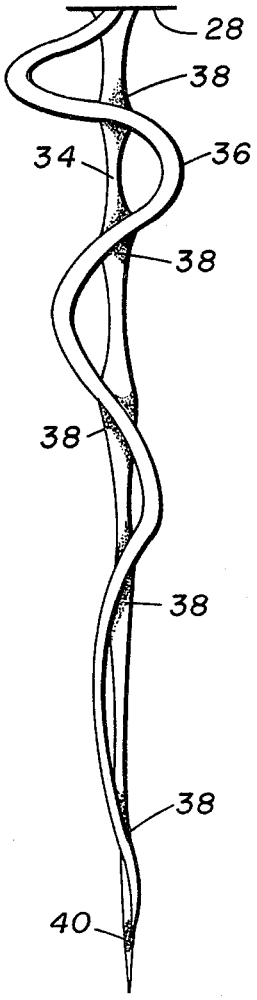
FIG. 4 is a side elevation view of the molten streams issuing from the FIG. 1 spinneret.

When polyester polymer is spun through the combined orifice, a remarkable phenomenon occurs, as illustrated in FIG. 4. Due to the geometry of the spinneret construction, the polymer flowing through the smaller capillaries 30 has a higher velocity than that flowing through the larger capillaries. The speeds and momenta of the paired streams issuing from each combined orifice and the angle at which the streams converge outside the spinneret are such that the slower streams 34 travel in substantially straight lines after the points at which the paired streams first touch and attach, while each of the smaller and faster of the streams 36 forms sinuous loops back and forth between successive points of attachment 38 with its associated larger streams. This action can be readily observed using a stroboscopic light directed onto the stream immediately below the spinneret face 28. As the molten streams accelerate away from the spinneret, the slower stream attenuates between the points of attachment 38 and the loops of the faster stream become straightened until the faster stream is brought into continuous contact with the slower stream. The slower stream attenuates more between than at the points of first attachment, so that the resulting combined stream has a cross-section which is larger at the points of first attachment than in the regions between these points. The resulting combined stream is then further attenuated somewhat until it is solidified into a filament 40 by the transverse quench air.

Figure 3:
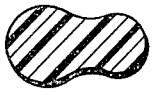
FIG. 3 is a cross-sectional view of the first type of filament according to the invention.
Figure 5:
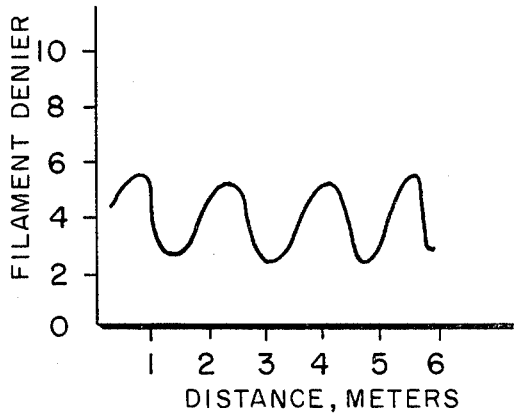
FIG. 5 is a graph illustrating the variation in denier along a representative filament of the first type.

Each solidified filament has non-round cross-sectional areas (FIG. 3) which vary repetitively along its length, the regions of large area having much higher shrinkage than those of small area. As shown qualitatively in FIG. 5, when using the spinning conditions given below, the filament cross-sectional area varies at a repetition rate of the order of magnitude of about one per meter, although this can be varied somewhat by modifying the spinning conditions and the geometry of the spinneret passages.

Figure 6:
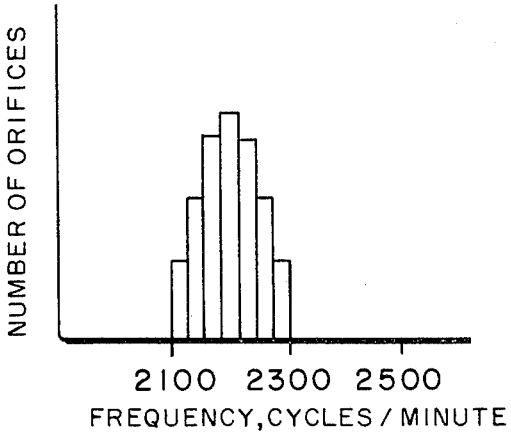
FIG. 6 is a graph illustrating the distribution of the fluctuations illustrated in FIG. 4 for a representative multiple orifice spinneret according to the invention.

Due to minor differences between combined orifices, temperature gradations across the spinneret, and other like deviations from exactly the same treatment for each pair of streams, a multiple orifice spinneret will typically provide somewhat different repetition rates among the several resulting streams and filaments. An example of this is qualitatively shown in FIG. 6, wherein is shown that various orifices produce somewhat different repetition rates as determined by stroboscopic examination of the combined streams just below the spinneret face.

When such a yarn is heated under low tension, the high shrinkage regions in a filament contract more than the low shrinkage regions in adjacent filaments, which are placed under compression and forced to bulge out and protrude from the yarn bundle, yielding crimp. If the degree of shrinkage amplitude variations were too small, or if the shrinkage amplitude variations along the filaments were in phase, a useful degree of crimp would not be obtained.

Advantageously, the spinneret is so designed that one of the individual streams has a velocity in its capillary between 2.0 and 7 times (preferably between 3.5 and 5.5 times) the velocity of the other of the streams in its capillary. Further advantages are obtained when the faster of the two streams has a smaller cross-sectional area than the slower of the streams, particularly in degree of crimp and spinning stability.

The second class of filaments may be spun from spinneret orifices selected such that, at the given common spinning speed, the filaments of the first class will have a higher shrinkage than those of the second class.

As a specific example, molten polyethylene terephthalate polymer of normal molecular weight for textile apparel yarns is extruded simultaneously through two spinnerets, one of which contains 34 combined orifices as above described and the other of which contains 34 round orifices having diameters of 0.009 inch (0.229 mm.). The extrusion rates are selected such that each resulting class of 34 filaments has a denier of 77 at a winding or spinning speed of 5600 ypm (about 5100 meters per minute). The 68 molten streams are quenched into filaments by transversely directed moving air, and the 68 filaments are converged into a common yarn bundle and wound on a bobbin at 5600 ypm as a yarn having a denier of 154.

The yarn is heated to 150° C. while under low tension to develop the latent crimp in those filaments of the first class and to develop the shrinkage differences between the two classes of filaments. Those filaments of the first class, collected separately, have a shrinkage of 10.6%, while those of the second class, collected separately, have a shrinkage of 4.5%. The combined yarn has a shrinkage of 6.3%. Each filament of the first class has a periodic variation in denier from approximately one denier to approximately four denier, while the filaments of the second class protrude in relatively large loops from the yarn bundle.

To produce a more wool-like hand, the denier per filament of the filaments of the second class can be increased, the range of about 5–9 dpf being particularly suitable.

DEFINITIONS AND TEST METHODS

"Polyester" as used herein means those polymers of fiber-forming molecular weight composed of at least 85% by weight of an ester or esters of one or more dihydric alcohols and terephthalic acid.

The shrinkage profile (and 5 cm. shrinkages) are determined by separating from the yarn bundle a single filament 2.5 meters long, care being taken not to stretch the filament. The filament is then cut into consecutive serially numbered 5 cm. samples or segments, which are then placed while unrestrained in boiling water for 30 seconds. The length of each segment is then measured, and its shrinkage amplitude as a percentage of the original 5 cm. length is calculated. For example, if a segment has a length of 4.2 cm. after the treatment with boiling water, its shrinkage amplitude would be 16%. The percentage shrinkage amplitudes when plotted in serial number order, provides a profile of shrinkage variation along the filament.

In contrast to the above 5 cm. shrinkage test of individual filaments, yarn properties are determined in the following manner. The yarn is conditioned for at least one hour in an atmosphere of 22° C. and 65% relative humidity. If the yarn is wound on a package, at least 100 meters are stripped off and discarded. The yarn is skeined under a tension of 0.035 grams per denier on a Suter denier reel or equivalent device having a perimeter of 1.125 meters per revolution to a total skein denier of approximately (but not to exceed) 8000, and the ends are tied. For example, for a 170 denier yarn, 24 revolutions would give a skein denier of 8160. In this instance, 23 revolutions would be used. The skein is removed from the denier reel and suspended from a 1.27 cm. diameter round bar. A 1000 gram weight is gently lowered until the weight is suspended from the bottom of the skein by a bent #1 paper clip or equivalent piece of wire weighing less than 1 gram. After 30 seconds, the skein length is measured to the nearest 0.1 cm., the measured length being recorded as $L_o$. The 1000 gm. weight is then replaced with a 20 gm. weight, and the rod with the suspended skein and 20 gm. weight are placed in a 120° C. oven for 5 minutes. The rod with the suspended skein and 20 gm. weight is removed from the oven and conditioned for 1 minute at 22° C. and 65% relative humidity, after which the skein length $L_1$ is determined to the nearest 0.1 cm. The 20 gm. weight is then carefully replaced by the 1000 gm. weight. Thirty seconds after the 1000 gm. weight has been applied, the skein length $L_2$ is determined to the nearest 0.1 cm. The percentage crimp is then calculated as $$(L_2-L_1)/L_2\times 100,$$

while the percentage yarn shrinkage is calculated as $$(L_o-L_2)/L_o\times 100$$

Occasionally the filaments in a skein will be so highly entangled that, when the 20 gm. weight is replaced by the 1000 gm. weight, the length $L_2$ is about the same as $L_1$, even though the skein obviously has not had its crimp pulled out. In such a case, the 1000 gm. weight may be gently jarred until the weight falls and removes the crimp. To characterize a yarn, 100 samples are tested by the procedures in this paragraph, the highest 10 and lowest 10 values being discarded and the remainder averaged to arrive at crimp and shrinkage values for the yarn.

What is claimed is:

1. A multifilament yarn comprising first and second classes of filaments;

a. each of said first class of filaments being melt spun polyester filaments of at least two polymer streams fused together at different extrusion rates to provide filaments of nonround cross sections having shrinkage profiles in the form of shrinkage peaks and valleys along their lengths, said shrinkages peaks and valleys being out of phase from filament to filament and having amplitudes and spacings along each of said filaments of said first class selected such that said yarn has a crimp above 2%;

b. each of said second class of filaments having lower shrinkage than the shrinkage of said filaments of said first class.

2. The yarn defined in claim 1, wherein each of said second class of filaments has a denier larger than the average denier of said first class of filaments.

3. The yarn defined in claim 1, wherein said second class of filaments are polyester.

4. The yarn defined in claim 1, wherein said shrinkage peaks and valleys have amplitudes and spacings selected such that said yarn has a crimp above 3%.

5. The yarn of claim 1 wherein the two classes of filaments are of the same polymer.

6. The yarn of claim 2 wherein the second class of filaments has a denier in the range of about 5 to 9 denier per filament.

7. A heat treated yarn bundle comprising the multifilament yarn of claim 1 in the bulked state wherein loops of individual filaments protrude from the yarn bundle.

* * * * *